US006481499B2

(12) United States Patent
Lopes

(10) Patent No.: US 6,481,499 B2
(45) Date of Patent: Nov. 19, 2002

(54) WELL-BOTTOM GAS SEPARATOR

(75) Inventor: Divonsir Lopes, Rio de Janeiro (BR)

(73) Assignee: Petroleo Brasileiro S.A., Petrobras (BZ)

( * ) Notice: Subject to any disclaimer, the term of this patent is extended or adjusted under 35 U.S.C. 154(b) by 0 days.

(21) Appl. No.: 09/730,735

(22) Filed: Dec. 7, 2000

(65) Prior Publication Data

US 2001/0004017 A1 Jun. 21, 2001

(30) Foreign Application Priority Data

Dec. 20, 1999 (BR) ..... 9905912

(51) Int. Cl.[7] ..... E21B 43/32; E21B 47/04

(52) U.S. Cl. ..... 166/250.03; 95/261; 96/158; 96/165; 96/167; 96/209; 96/211; 166/53; 166/105.5; 166/265

(58) Field of Search ..... 95/241, 261, 262; 96/157, 158, 165, 167, 195, 208, 209, 211; 166/53, 54, 66, 105.5, 250.03, 250.15, 265

(56) References Cited

U.S. PATENT DOCUMENTS 2,491,587 A * 12/1949 Seago ..... 137/202
4,023,941 A * 5/1977 Miller ..... 96/170
4,531,584 A 7/1985 Ward ..... 166/265
4,762,176 A * 8/1988 Miller ..... 137/403
4,981,175 A 1/1991 Powers ..... 166/265
5,309,998 A * 5/1994 Rivas et al. ..... 166/105.5
5,431,228 A 7/1995 Weingarten et al. ..... 166/357
5,482,117 A 1/1996 Kolpak et al. ..... 166/265
5,525,146 A * 6/1996 Straub ..... 166/105.5
5,715,890 A * 2/1998 Nolen ..... 166/250.03
6,036,749 A * 3/2000 Ribeiro et al. ..... 210/188
6,085,836 A * 7/2000 Burris et al. ..... 166/250.03
6,116,338 A * 9/2000 Morrison et al. ..... 166/105.5
6,155,345 A * 12/2000 Lee et al. ..... 166/105.5
6,179,054 B1 * 1/2001 Stewart ..... 166/105.5
6,234,248 B1 * 5/2001 Knight ..... 166/105.5
6,277,286 B1 * 8/2001 Søntvedt et al. ..... 166/105.1

* cited by examiner

*Primary Examiner*—George Suchfield
(74) *Attorney, Agent, or Firm*—Nixon & Vanderhye PC

(57) ABSTRACT

This is a high-efficiency item of equipment, for example for a well bottom for separating out gas from a liquid/gas mixture, based on the effects of flows of the cascade and segregated types. It consists basically of a sedimentation vessel whose lateral surface has holes in the upper portion, enclosing (i) a discharge pump, (ii) a suction pipe and (iii) the lower end of a production tubing. The vessel contains helicoidal surfaces for achieving segregated-type flow. A significant part of separation takes place above the level of the separator, in a medium in which there is a predominance of gas and the flow is in the form of a cascade.

10 Claims, 5 Drawing Sheets

WELL-BOTTOM GAS SEPARATOR

FIELD OF THE INVENTION

The present invention relates to equipment used in petroleum-production activities.

It relates to a separator for carrying out a process of gravitational separation of immiscible fluids of different densities.

More particularly, it relates to a piece of equipment for separating out the gaseous phase of a liquid/gas mixture for use, preferably, at the bottom of a petroleum well, so as to reduce the proportion of gas in the liquid to be pumped to allow the bottom pump to be able to operate more efficiently.

It may also be applied in the petrochemical, chemical or similar industries.

BASIS OF THE INVENTION

In nature, petroleum is generally mixed with water and gas.

When the flow pressure of a production well is low, one problem to be solved is that of deciding how to transfer the petroleum up from the bottom of the well to the site where it will undergo initial processing. Transfer may be by means of pumps of various types or of some other suitable artificial lift means, such as gas lift, for example. A decision of this type will depend, inter alia, on the characteristics of the fluids produced and on environmental conditions. By opting for pumping, the lift-system efficiency will be increased if the gaseous phase has already been separated from the liquid portion of the petroleum.

The object of the present invention is to promote efficient separation, even at the bottom of the well, of the gas which is mixed with the liquid phase of the petroleum so as to make viable the exploitation of certain onshore or offshore hydrocarbon reserves.

The separation of the fluid originating from the reservoir into two distinct streams, one liquid and the other gaseous, allows reserves to be exploited by means of conventional technologies which are well known in the petroleum industry. On account of its low density, the gas is easily lifted by means of the small pressure difference between the bottom of the well and the reception vessel located at an onshore processing facility or a production platform, whilst the liquid stream may be lifted, for example, by means of sucker rod pumping (SRP) or another suitable pumping method.

The invention will make it possible to extend to fields with a high gas/liquid ratio, which are restricted to gas lift, the application of artificial lift methods using SRP, progressive cavity pumping (PCP), electrical submersible pumping (ESP) and jet pumping (JP). The gas lift method is inefficient in satellite offshore wells, in onshore wells with long gush lines, in deep wells, in directional (non-vertical) wells and in wells containing viscous oils. As the reservoir becomes depleted, gas lift also becomes less efficient. Many onshore wells are sufficiently depleted that they cannot operate with gas lift, so they operate by using SRP or PCP. These wells, which currently operate inefficiently owing to the low separation efficiency, will benefit from the invention.

In the case of offshore exploitation, separation at the bottom of a well results in a saving of physical space and a reduction in the load on the deck of the production platform.

Greater production may be obtained through the application of the invention, coupled with SRP, PCP or JP, in order to remove condensate in gas wells.

Moreover, in the case of a natural reservoir, a further advantage of this separation process relates to monitoring of reserves. Separate monitoring of the production of liquid and gas will allow better management of the petroleum reservoir. Separation of the liquid and gas flows means that they can be measured more easily, which is important when one considers the difficulties involved in measuring a multiphase flow.

In addition, in areas other than petroleum production, the invention has an application in industry in general.

PRIOR ART

The reduction in the efficiency of a petroleum-well pumping system, owing to the presence of free gas, has been known about for some time. The first patent for a separator, for reducing the amount of free gas in the suction region of a bottom pump, was granted in 1881. Since then, many others have been published because, depending on operational conditions, the use of known separators has not always resulted in satisfactory pumping efficiency.

The efficiency of static separators currently in use is low. This is the principal reason for the low volumetric efficiency of sucker rod pumping which, on average, is of the order of fifty per cent. This is a cause for concern, since it is estimated that approximately seventy to eighty per cent of producing wells use sucker rod pumping (SRP), progressive cavity pumping (PCP) or electrical submersible pumping (ESP).

Recently, it has become important to increase the gas-separation efficiency in subsea wells (wet Christmas tree) equipped with electrical submersible pumping (ESP), which is a method applicable in offshore wells equipped with a wet Christmas tree. According to preliminary studies, ESP would appear to be more advantageous than gas lift or underwater multi-phase pumping. Such studies were based on a well-bottom gas-separation efficiency level of the order of ninety per cent. However, it was observed that the efficiency of the available centrifugal separators is not constant, and that it dropped dramatically above a certain flow rate. Principally in the case of offshore wells with high flow rates, the situation is critical since SRP and PCP cannot be used in such wells and ESP requires high separation efficiency which is normally not achieved. This gives rise to a large quantity of gas in the pump which, in turn, increases the number of failures, increases costs and makes centrifugal pumping non-viable.

Amongst currently used bottom separators, the separation efficiency of which is below that which is desired, mention may be made of the following types: natural anchor, conventional (poor boy), cup, packer and inverted shroud. As these are well known, this description will deal, by way of comparison of the separation conditions involving bubbling or cascading, with only the conventional separator.

The process used in known bottom separators normally consists in projecting the two-phase mixture into a medium whose continuous phase is liquid. Under such conditions, the gas is forced to bubble towards the dynamic level of the well, and the efficiency of separation is limited to the speed of ascent of the bubbles in the liquid.

According to Stokes' Law, the bubbles ascend at a speed which is inversely proportional to the viscosity of the liquid:

$$v=[g(\rho_l-\rho_g)d^2]/18\mu_l$$

in which:

g gravitational acceleration;

$\rho_l$ liquid density;

$\rho_g$ gas density;

d bubble diameter;

$\mu_l$ liquid viscosity.

A practical and simplified formula involves a speed of 0.5 (feet per second) divided by the liquid viscosity (centipoise), as proposed by Ryan (1994).

Other authors recommend using Stokes' Law for Reynolds numbers between 0 and 2, and suggest special equations for other bands.

The present invention proposes the use of a different effect, herein called the "cascade effect", for altering the separation process which has been in use, making the situation similar to what occurs in the case of surface separators.

The cascade separator of this invention, with or without helicoidal surfaces, is installed inside the casing of a well, at the bottom but upstream from the discharge pump, in order to prevent or at least minimize the entry of gas into the pump and consequently to maximize the volumetric efficiency of the pumping operation.

In the equipment of this invention, the two-phase mixture is projected into it, above the liquid level of the separator, into a medium whose continuous phase is gas. Thus, instead of bubbling in a medium in which the continuous phase is liquid, there is a cascade or shower of droplets, whereupon segregation of the gas takes place more rapidly.

However, the conditions of said flow are still not ideal for separation. In order to obtain a more favourable flow, of the "segregated" type, the invention proposes the inclusion of helicoidal surfaces in the descending path of the mixture. The helicoidal surfaces convert the chaotic, descending vertical flow into an inclined, segregated flow, in a free surface channel flow, which better promotes phase separation. On the helicoidal surfaces, the Jukovski's effect and the thrust caused by the centrifugal acceleration increase the speed of segregation of the bubbles.

U.S. Pat. No. 5,482,117 issued Jan. 9, 1996 describes a helicoidal bottom separator for application in centrifugal pumping. Although helicoidal, that separator is based on a different operating principle from that of this invention. In said patent, the mixture passes over the helicoidal surface in an ascending direction, where it is subjected to the action of centrifugal forces which promote gas separation. The liquid is forced to move to the peripheral part, and the gas to the radially inner part (shaft), of the helicoidal surface. Another important difference is the fact that said separator operates when immersed in liquid, which is the continuous phase, which makes additional segregation of the bubbles problematic. Despite the presence of helicoidal surfaces, a stratified or segregated flow is not achieved. As the movement of the fluid is ascending, a chaotic slugging flow occurs, with the formation of bubbles and a dense mist, which is undesirable for a more efficient separation process.

In the present invention, the descending helicoidal flow is naturally stratified, even in the absence of centrifugal forces, i.e. even if the flow rate or speed of the fluid on the helicoidal surfaces is low. In order to guarantee that gas is the continuous phase, avoiding the formation of slugs or immersion of the helicoidal surfaces, this invention provides:

- the installation of a regulating (or controlling) valve in the gas line;
- a long separator, in order to contain variations in level, guaranteeing a cascade-type flow;
- a perforated separator vessel, in order to allow the entry of the fluid under favourable conditions, separation taking place partly through capillary effect;
- a helicoidal surface of variable pitch; and
- a gas discharge tube.

U.S. Pat. No. 5,431,228 issued Jul. 11, 1995 is similar to U.S. Pat. No. 5,482,117 discussed above. It is simpler because there is no passage of a drive shaft through its inside. The flow is ascending, presenting the same problems of separation already noted. It may be stated that U.S. Pat. No. 5,482,117 operates principally in wells equipped with electrical submersible pumping and that U.S. Pat. No. 5,431,228 operates in wells equipped with sucker rod pumping, progressive cavity pumping, jet pumping, etc., in which there is no drive shaft passing through the separator.

U.S. Pat. No. 4,981,175 issued Jan. 1, 1991 describes a centrifugal separator in which the helicoidal surfaces rotate whilst the casing remains stationary, there being a clearance between these two components. Because it rotates, the helicoidal surface is known as an impeller or rotor, and requires a motor to actuate it. In the helicoidal separation of this invention, the helicoidal surfaces do not rotate, there is no need for external drive power and the helicoidal surfaces are joined to the casing so that there is no fluid leakage.

U.S. Pat. No. 4,531,584 issued Jul. 30, 1985 is similar to U.S. Pat. No. 5,431,228. Once again, the operating principle is that of ascending helicoidal flow with high speeds so that separation takes place by means of centrifugal effect. This patent, also fails to solve the problems of immersion, which are exacerbated by the existence of tiny, flooded gas passages. The liquid in the annular space floods the radially inner part of the helicoidal surfaces where the gas tends to accumulate. Thus, the conclusion is that it will be difficult for a segregated flow to occur over the helicoidal surfaces and that, over the inner portion thereof, there will be a flow of liquid with a greater concentration of bubbles.

SUMMARY OF THE INVENTION

The invention relates to a high-efficiency well-bottom separator, of the "cascade" type, which uses helicoidal surfaces to obtain a stratified descending flow, which promotes separation.

More specifically this invention provides a gas separator, for separating out the gaseous phase from a two-phase, liquid/gas mixture, comprising a sedimentation vessel equipped in the upper part with openings for the passage of a production tubing and for the exit of gas has been separated out, and having a lateral surface with an upper portion having through-holes therein; said holes forming, in said lateral surface of the sedimentation vessel, a perforated tube; wherein in use of said gas separator said sedimentation vessel contains liquid, in its lower part, up to a level varying within a selected band below the holes in said perforated tube, and contains predominantly gas in its upper portion, above the level of the separator; and wherein said vessel contains a discharge pump to be connected to receive a production tubing.

Internally, between a production tubing and the inner lateral surface of the sedimentation vessel, over the height of said vessel, there may be helicoidal surfaces. In the upper part of the helicoidal channel there may be a helicoidal discharge tube for part of the gas which has been separated out to flow to the annular space of the well. The lower portion of the separator will be immersed in liquid up to a selected level, which can vary within a certain band, below the perforated portion of the lateral surface.

The invention also relates to the use of such a gas separator at a well bottom.

DETAILED DESCRIPTION OF THE INVENTION

To aid understanding, the invention will be described with reference to the Figures which accompany this description. However, it should be pointed out that the Figures diagrammatically illustrate only one preferred embodiment of the invention and therefore imply no limitation. In accordance with the inventive concept to be described, it will be clear to specialists in the field that it is possible to make use of variations in the forms and in the arrangements presented, or to make use of supplementary devices, within the scope of the invention.

Figure 1:
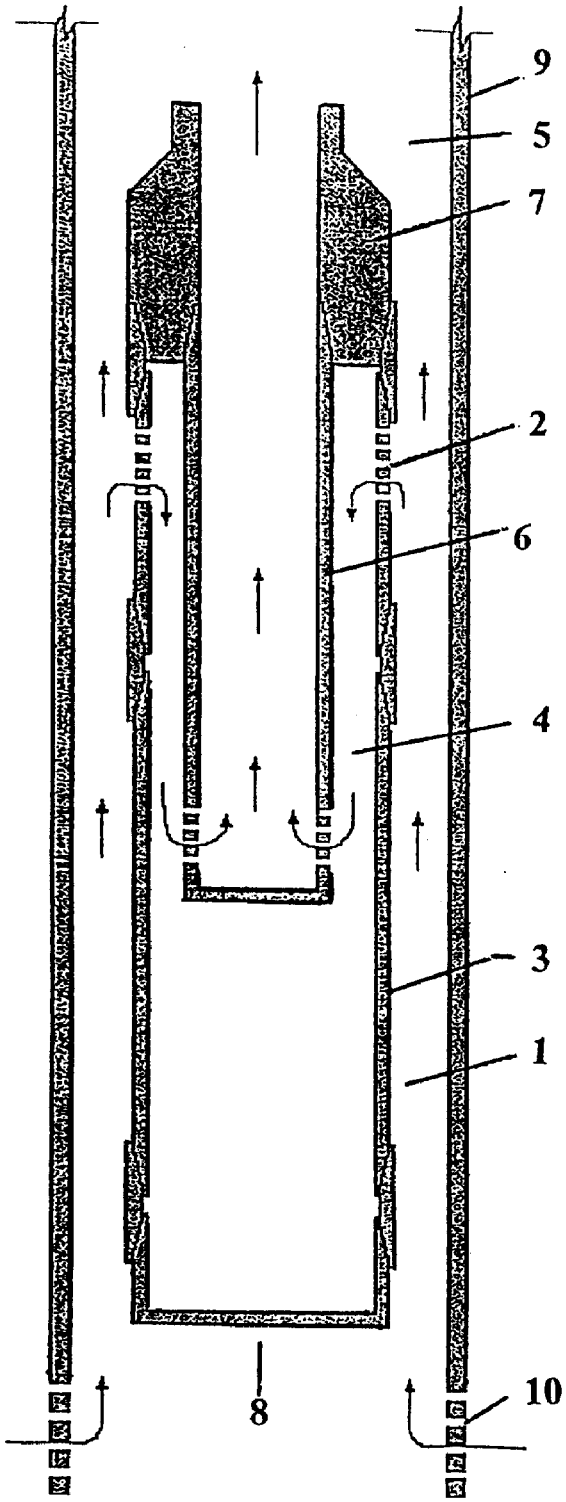
FIG. 1 shows a diagrammatic longitudinal section of a conventional (poor boy) bottom gas separator, according to the prior art.

FIG. 1 shows a conventional well-bottom separator according to the prior art. This type of separator is fairly widely used despite its not offering highly efficient separation. Its principal advantages are the low cost of manufacture and the fact that it presents few problems in operation. The invention is illustrated by means of FIGS. 2 to 5 inclusive.

As shown in FIG. 1 the conventional separator (8), also known as a poor boy separator, is seated above the perforations (10), allowing the sedimentation of sand at the bottom of the well. The fluid, a mixture of liquid and gas, originating from the productive rock, ascends via the annular space (1) between the separator (8) and the casing (9) of the well, entering a sedimentation vessel (3) which forms the separator (8), via holes (2) in the upper portion of its lateral surface.

In practice there is no separation in the ascending flow of the fluid, in the opposite direction from the gravitational field, via said annular space (1), from the region of the perforations (10) to the region of the holes (2) in the sedimentation vessel (3).

In the flow of fluid, from the annular space (1) between the separator (8) and the casing (9) of the well to the annular space (4) between the inner lateral surface of the sedimentation vessel (3) and a longitudinal axial suction tube (6), the horizontal component of the movement, perpendicular to the gravitational field, promotes the greater part of separation. Another part takes place within the separator (8) in the annular space (4) between the sedimentation vessel (3) and the suction tube (6). This is due to the descending vertical movement, in the direction of the gravitational field, when the coalescence of gas bubbles is minimal and the flow directly opposes segregation of said bubbles. It is worth noting that the horizontal movement opposes segregation only perpendicularly. The gas which has been separated out rises via the annular space (5) of the well, between the casing (9) and a production tubing (not shown in FIG. 1), and the liquid rises via a suction tube (6), entering a bottom pump (also not shown in FIG. 1), which discharges it to the surface via said production tubing. The bottom pump is connected to the suction tube (6) by means of a reduction component (7) positioned at the upper end of the suction tube (6).

Peixoto and Passos Filho (1983 and 1984) increased the efficiency of poor boy separators by reducing the diameters of the holes (2) in the sedimentation vessel (3) from ⅝" to ⅜". However, this improvement was insufficient to substantially increase the efficiency of this type of separator.

Figure 2:
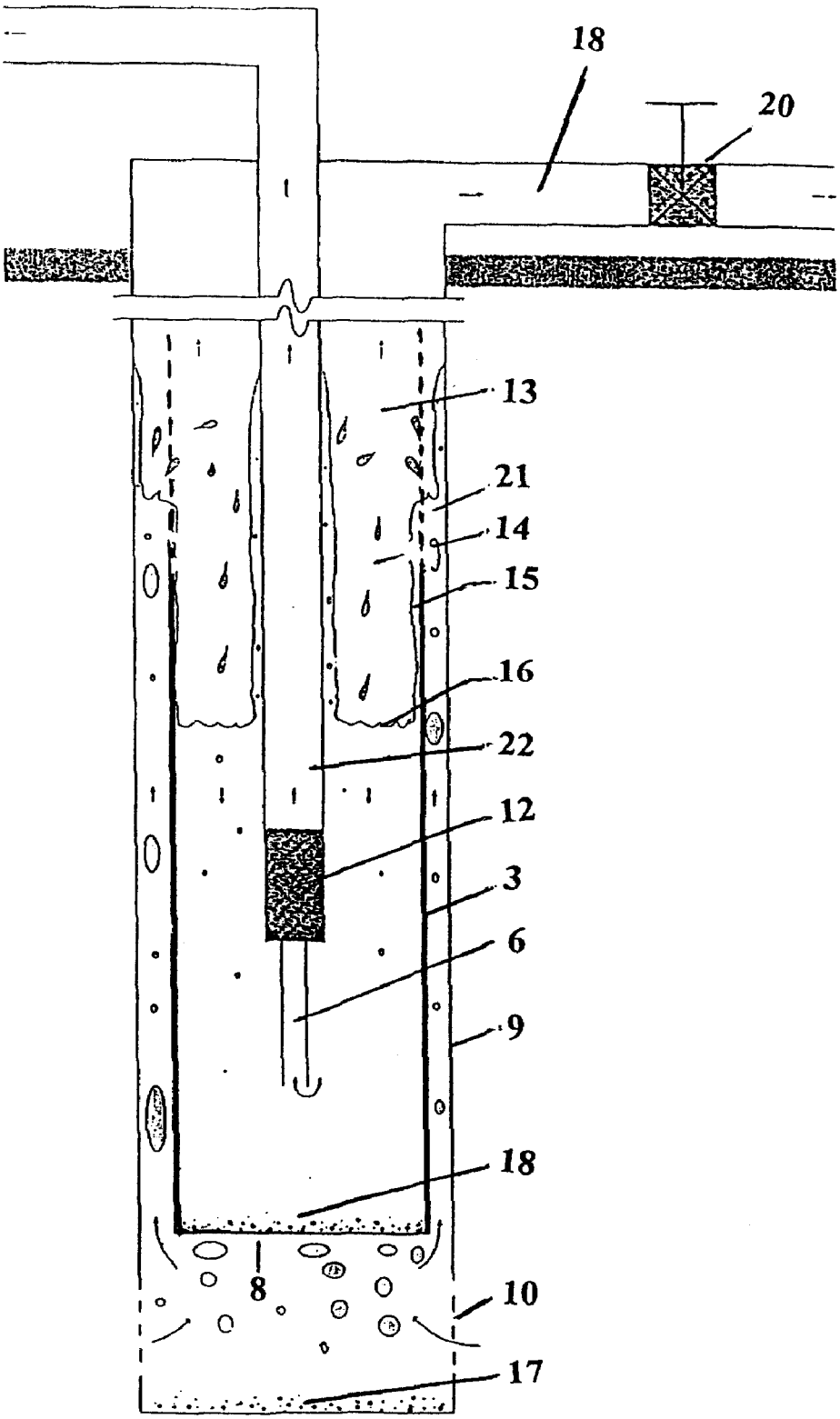
FIG. 2 shows a diagrammatic longitudinal section of a bottom gas separator, of the cascade type, according to the invention.

FIG. 2 shows the basic design of a separator (8) of the cascade type according to the present invention. Although similar to the inverted shroud, the separation principle used in known bottom separators was altered, being made similar to that of surface separators. The "cascade" effect is characterized by the existence of a region (13) in the sedimentation vessel (3) of the separator (8), between the site (21) of entry of the mixture and the level (16) of the liquid which has accumulated in the bottom of the separator (8), where the continuous separation medium is gaseous. In this region (13) the mixture descends as droplets (14) or flows over the wall of the sedimentation vessel (3), forming a kind of cascade (15).

The two-phase mixture originating from the region of the perforations (10) enters a sedimentation vessel (3), of which the separator (8) is made, via holes which exist in a section of its upper lateral surface, herein called the perforated tube (21), and flows to the level (16) of the separator. In this region between the upper edge of the perforated tube (21) and the level (16) of the separator, the gas is the continuous phase and consequently segregation is much more rapid than in a medium in which the continuous phase is liquid.

In general, the well starts production with a high static level and the separator (8) completely immersed, i.e. with separation taking place by means of bubbling. To guarantee the changeover from this type of separation to the "cascade" type it is necessary to lower the dynamic level inside the sedimentation vessel (3). This may be achieved by installing a control means, herein generically called a "regulating valve", such as for example a choke valve (20) in the line (18) for gas collection, which must be kept closed until the dynamic level reaches a selected position inside the sedimentation vessel (3). Thus, during well start-up, the regulating valve (20) must be kept closed whilst the level (16) of the separator is above the selected position and must be kept open after this level (16) has been reached, or must vary within a preselected band inside the sedimentation vessel (3).

Maximum pumping of liquid is achieved when the level (16) of the separator is stabilized in the selected position inside the sedimentation vessel (3), with the regulating valve (20) fully open, i.e. with the valve adjusted to zero pressure or the lowest possible pressure. If the level (16) of the separator stabilizes only with the regulating valve (20) partially closed, i.e. with the valve (20) adjusted to a gauge pressure above zero, production will be less because the casing (9) of the well, pressurized with gas, will give rise to a counterpressure over the productive rock. However, if the regulating valve (20) is opened to eliminate said gas counterpressure, production will be still less, since the gas counterpressure will be replaced by a greater liquid counterpressure. Under such conditions the dynamic level of the well will rise a long way above the perforated tube (21), adversely affecting pumping performance since the efficiency of separation using bubbling is less than that of separation using a cascade.

The level (16) of the separator may be controlled manually or automatically. If manual control becomes difficult it is recommended that automatic level control be adopted. Manual control may be achieved relatively easily in a variety of ways.

If an acoustic sounder, also known by the registered trade mark "Sonolog", is used to measure the level, sound waves are generated at the wellhead by means of an explosion. The sound waves, which collide with the various couplings of the production tubing (22), return to the wellhead and are picked up by the "Sonolog". This takes place until the sound waves reach the level (16) of the separator, where the last reflection occurs. The number of couplings picked up by the "Sonolog" indicates the number of tubes which are above the level (16) of the separator and consequently the depth of the level (16) of the separator may be calculated as a function of the length of each tube.

The depth of the level (16) of the separator may also be obtained by means of dynamometers. Dynamometers measure cyclic loads occurring in pumping units. The presence of gas in the pump is easily detected, since it disrupts the cyclic loads which are recorded on the dynamometric chart. Thus at the time of well start-up, whilst the dynamometric chart does not indicate the presence of gas, the level of the separator will be high and the valve will have to be kept closed. When the chart begins to indicate that gas is present, owing to the dynamic level having dropped to the separator (8), it is necessary to initiate opening of the regulating valve (choke or pressure-control valve, for example), reducing its set pressure so as to avoid an excess of gas in the pump which may block the entry of liquid. When this process is complete the ideal would be for there to be no gas or a minimum of gas indicated on the chart, with the choke fully open or with the pressure of the control valve adjusted to zero.

Another way in which to adjust the opening of the choke or the pressure of the control valve is by means of production tests. This consists in operating the well with different pressures in the annular space and adopting the pressure which resulted in the maximum flow rate of liquid and, consequently, gave rise to the least flow rate of gas through the pump and the maximum flow rate through the gas line.

Depending on the geometry of the well and on the fluids produced, significant oscillations may occur in the flow rate of liquid. When the level is controlled by "Sonolog", dynamometer or a production test, it is recommended that the pressure in the annular space be adjusted in order to maintain the specified level in the separator at times of maximum fluid flow rate. This adjustment may result in excessive pressures in the annular space, which may reduce the well flow rate. In order to avoid this problem another type of control may be adopted, namely automatic control, in the form of a control valve in the gas line and of a level sensor.

It may be noted that the level control of the invention is different from conventional control. In conventional control, which is normally used in the industry, a valve is installed in the liquid line and it opens when the level rises and closes when the level descends so as to keep it within a specified band. In the type of level control now proposed, the regulating valve is installed in the gas line. When the level rises, the valve closes, the counterpressure over the productive rock increases, the flow rate of liquid drops and the level is maintained within the selected band. The opposite occurs with a low level. In that case the valve opens, the counterpressure over the productive rock drops, the liquid flow rate increases and the level is maintained within the permitted band.

Conventional level sensors may be fitted at the well bottom, these including, for example, a differential pressure sensor, a buoy, a level key, an acoustic or optical sensor, etc. In order to maximize well production, it is possible to adopt or combine several solutions for level control.

With reference to FIG. 2 it will be noted that, on the one hand, it is advantageous to extend the sedimentation vessel (3) for separation to begin to take place at the upper edge of the perforated tube (21) at a low pressure and for the discharge pump (12) to operate much lower down at a higher pressure corresponding to the pressure of said upper edge increased by the hydrostatic column. On the other hand, in order to minimize the counterpressure over the productive rock the length of the sedimentation vessel (3) must be sufficient for the level of the separator (16) to be stabilized immediately below the lower edge of the perforated tube (21), with the regulating valve (20) fully open.

The cross-sectional area of the sedimentation vessel (3) must be as large as possible in order to maximize separation efficiency. However, it must be less than or equal to the passage diameter (drift) of the casing (9) of the well and must allow the separator (8) to be withdrawn (fished). The separator (8) should preferably be installed where the diameter of the casing (9) is greatest.

As soon as it exits the region of the perforations (10), part of the sand settles at the well bottom (17). A further part, before the flow enters the suction tube (6) of the pump (12), is deposited at the bottom (18) of the sedimentation vessel (3).

The cascade-type separator is able to separate out a large amount of gas in the perforated tube (21), from where the liquid descends as drops or as a cascade to the inside of the sedimentation vessel (3). The greater part of the gas rises directly via the annular space of the well. Inside the sedimentation vessel (3), below the perforated tube (21) and above the level (16) of the separator, part of the gas descends incorporated in the liquid. A first portion is separated from the liquid and rises via the annular space of the well. The remainder does not separate out and descends mixed together with the liquid.

The average flow rate of gas inside the sedimentation vessel (3) is low and is equal to the portion of gas which is not separated out and enters the pump (12). However, the volume of liquid may be increased, to the detriment of the volume of gas, without problems being caused. This characteristic can extend the application of artificial lift methods using sucker rod pumping (SRP), progressive cavity pumping (PCP),electrical submersible pumping (ESP), for dry and wet Christmas tree and jet pumping (JP): i)to fields with a high gas/liquid ratio, where gas lift is normally used; ii)to the removal of condensate in gas fields; or iii)to boosting, using ESP, in deep waters.

Use of the separator of the invention implicitly defines an individual separation method. In general terms, and considering that the well will begin production with a high static level, the method includes the steps of:

- fitting the separator at the well bottom;
- installing a regulating valve in the gas line (optionally, in the liquid-production line);
- determining the dynamic level of the well;
- moving the dynamic level inside the separator, below the region of the holes in the perforated tube by means of operating the regulating valve; and
- manually or automatically keeping the level of liquid in the separator within a specified variation band. The cascade-type separator according to this basic version has a number of shortcomings:
- the liquid descends rapidly, in free fall or by flowing over the walls, reducing the possibility of the gas being released from the liquid, principally because the flow has no horizontal speed component perpendicular to the gravitational field; and the impact of the liquid which descends on the liquid which has accumulated in the lower part of the separator may reincorporate gas into the liquid.

When the fluid flows over the walls of the vessel (3), only Jukovski's effect promotes separation. High speed gradients in the flow give rise to the circulation of liquid around the gas bubbles and consequently generate forces (Jukovski's effect) which move these bubbles (Kazanski, 1967).

Figure 3:
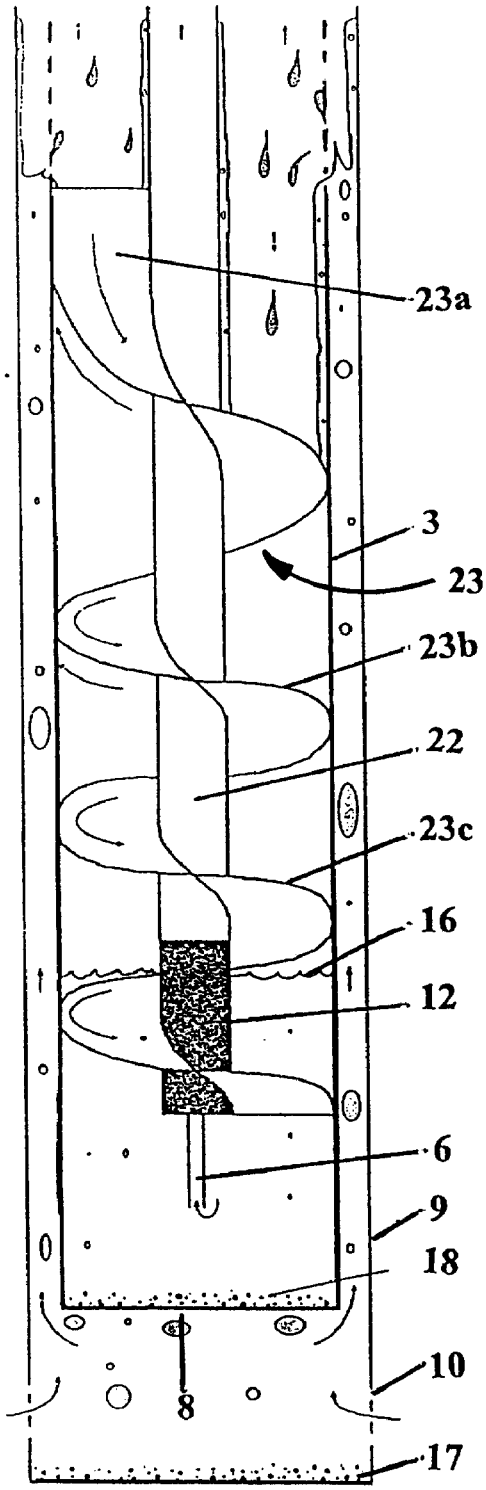
FIG. 3 shows a diagrammatic longitudinal section of a bottom gas separator of the cascade type, equipped with a helicoidal surface, according to the invention.

In order to optimize the performance level of this version of the separator (shown in FIG. 2), the invention proposes, as may be seen in FIG. 3, installing a helicoidal component (23) inside the sedimentation vessel (3). This component (23) extends, laterally, in the space between the inner lateral surface of the sedimentation vessel (3) and the outer lateral surface of the production tube (22) and, longitudinally, at least between the level (16) of the separator and the upper edge of the perforated tube (21). The upper portion (23*a*) and the lower portion (23*c*) of the helicoidal surface have a variable pitch. The intermediate portion (23*b*) may have a constant pitch. This helicoidal component (23) converts the chaotic, vertical descending flow into an inclined, segregated flow, in free surface channel flow, i.e. into a flow which better promotes phase separation.

In order for separation to be more efficient, as set forth above, the segregated flow must be guaranteed. Thus, the surface of the liquid which is flowing must not reach the head (formed by the previous turn) of the helicoidal channel. To this end it is recommended to adopt a downward slope in the channel, or helicoidal pitch, so that only one third (estimated value) of the cross-sectional area of the channel is occupied by the liquid, guaranteeing a segregated flow and preventing waves on the surface or fluctuations in the flow rate from being able to cause flows in the form of slugs, which are undesirable for separation.

In order to prevent turbulence and flooding, the pitch of the initial section (23*a*) of the helicoidal surface must be infinite so that, when the flow commences over the said section (23*a*) of the helicoidal surface, it is tangential to the direction of fall of the fluid. As the fluid descends, the pitch of the helicoidal surface (23) decreases until it reaches a value such that:

it maximizes the centrifugal force, which is added vectorially to the gravitational force, improving the separation conditions;

it minimizes turbulence;

it maximizes Jukovski's effect of the bubbles;

it maintains a minimum thickness of liquid over the helicoidal surface, minimizing the time the gas bubbles spend rising in this thickness.

If the speed of the liquid over the helicoidal surface (23), on nearing the level of the separator (16), is sufficiently high to give rise to gas reincorporation, the pitch of the helicoidal surface (23) must be reduced in order to reduce slowly the arrival speed of the liquid.

Use is made of a section of helicoidal surface with a constant pitch only to facilitate the construction of the equipment. In an ideal situation, the entire helicoidal surface would have a variable pitch, starting with an infinite pitch, which would decrease so as to keep constant the fraction of two-phase mixture in the bottom of the channel. This is because the volumetric flow rate of this mixture decreases as separation takes place, i.e. as the gas bubbles in the mixture move to the gas section which is in the upper portion of the cross section of the channel. In order to prevent flooding, that fraction of the height of the channel which is occupied by the two-phase mixture must be kept low, of the order of one third, as already seen. If necessary, upon nearing the level of the separator, this fraction should increase slowly, the pitch being reduced still further in order to prevent the occurrence of a hydraulic jump which could reincorporate gas into the liquid.

Figure 4:
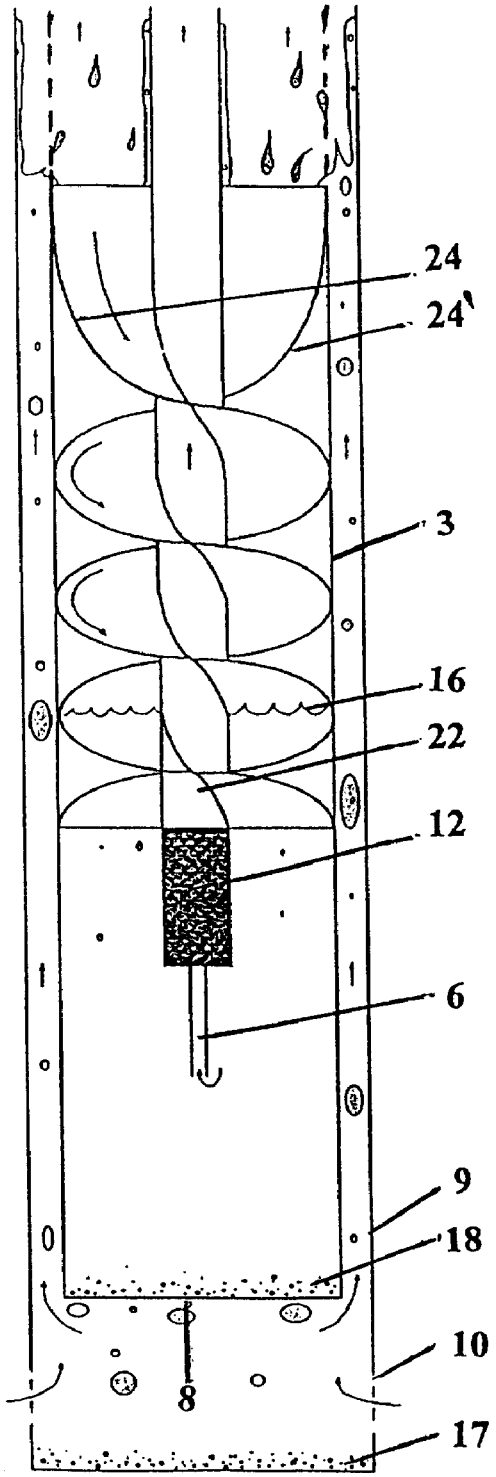
FIG. 4 shows a diagrammatic longitudinal section of a bottom gas separator of the cascade type, equipped with two helicoidal surfaces, according to the invention.

FIG. 4 shows the same separator as in FIG. 3, but with two helicoidal surfaces (24 and 24'). Generally speaking, this design offers a better performance level since the volume of liquid is divided and, consequently, the thickness of liquid over each helicoidal surface decreases, reducing the time required for separation, i.e. reducing the time the gas bubbles spend rising in said thickness.

Other, preferably uniformly spaced, helicoidal surfaces may be added. Each added helicoidal surface functions as a parallel separator, offering, in comparison with other types of more complex separator, the advantage of not having moving parts. Nevertheless, an excessive number of helicoidal surfaces may reduce separation efficiency by reducing the internal volume of the separator, in addition to increasing equipment cost.

The perforated tube (21) is a simple solution for preventing flooding of the separator and it offers a capillary effect which promotes separation. The holes in the perforated tube (21) have such a diameter and distribution that the flow rate of liquid per unit of perforated-tube length is minimal. In this manner, a condition is created which favours separation since the low horizontal speed of the liquid reduces the entrainment of the gas (which is rising via the annular space between the perforated tube (21) and the casing (9) of the well) via the holes to inside the sedimentation vessel (3). Importantly, it promotes the formation of a descending liquid film of minimum thickness in the inner part of the perforated tube (21) and in the outer part of the production tubing (22), i.e. preventing flooding, which occurs when the liquid films increase in thickness, combine and occupy all the annular space between the perforated tube and the production column (22).

The perforated tube (21) must not operate when immersed, i.e. the level (16) of the separator should be below the holes and the dynamic level of the well upstream of the holes should not go beyond them. However, the capacity of the holes must be greater than the maximum instantaneous flow rate of liquid in the well. The perforated tube (21) must be as long as possible in order to contain small holes which carry out separation by capillary effect, and in order to prevent flooding, better absorbing fluctuations in flow rate.

Figure 5:
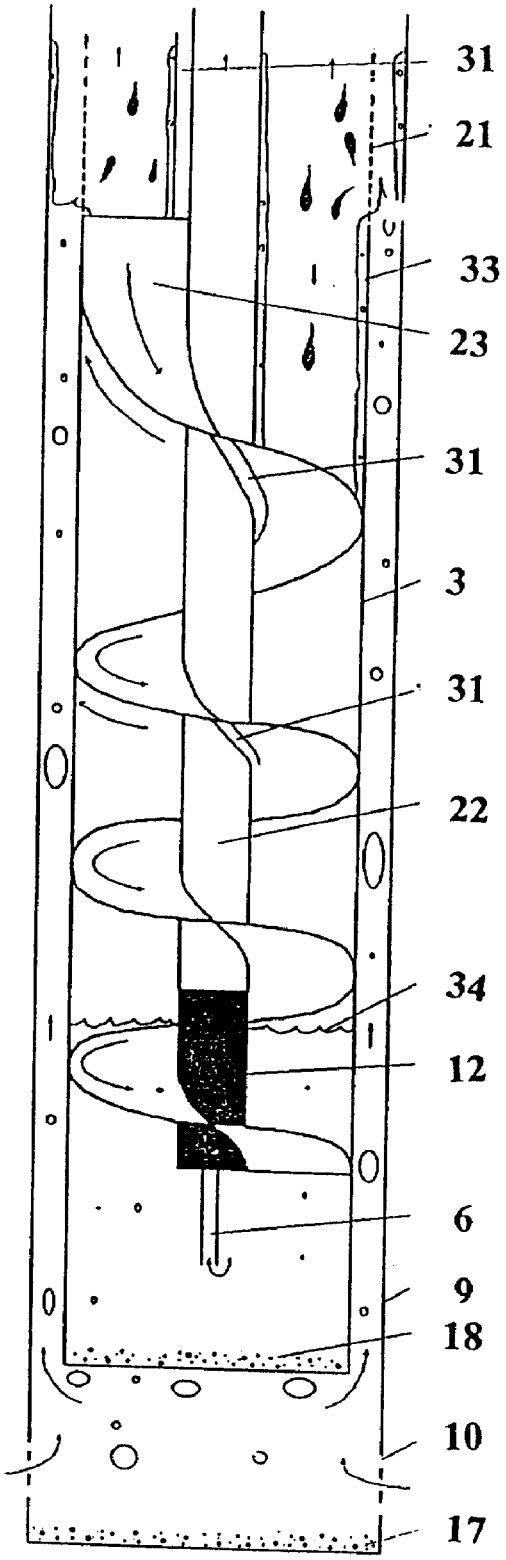
FIG. 5 shows a diagrammatic longitudinal section of a bottom gas separator of the cascade type, with a helicoidal surface and with a discharge tube, according to the invention.

In order to minimize the effects of any flooding, as may be seen in FIG. 5, the present invention makes use of a discharge tube (31). The discharge tube (31) does not allow pressurization of the separator (8) if flooding occurs, since it allows the gas below the flooded region to be vented freely to the annular space at a point above the flooded region, preventing its moving through the liquid medium to the pump (12).

The discharge tube (31) may be positioned in the upper portion, or head, of the helicoidal channel and close to the production tubing (22), i.e. in the gas section of the stratified flow which occurs in the helicoidal channel and as far away from the liquid as possible. The discharge tube (31) should run along the entire region which is likely to be flooded:

the lower region of the perforated tube (21), where the helicoidal surfaces have a variable pitch;

the region of the holes in the perforated tube (21); and the region of the annulus of the well as far as a point immediately above the dynamic level of the well under flooded conditions.

In the case where the sedimentation vessel has, on the inside, at least two helicoidal services equally offset along the circumference of the sedimentation vessel, at least two discharge tubes may be provided, each one extending over the upper portion of the respective helicoidal channel, and wherein the discharge tubes extend from the lower portion of the helicoidal surfaces to the annulus of the well, above the dynamic level of the well.

The discharge tube (31) should not contain liquid which can give rise to a hydrostatic column and consequently pressurization of the separator (8). The diameter of this tube (31) should be sufficient to allow for the countercurrent flow between the liquid and the gas, i.e. for the liquid to descend via the tube whilst the gas rises.

In order to increase the separation capacity, the width of the helicoidal surface (23 or 24) should be increased, i.e. the diameter of the production tubing (22) may be reduced and/or the diameter of the separator (8) increased. This may give rise to the need to drill a well of compatible diameter in order to make viable the intended increase in production.

Separation efficiency is proportional to the diameter of the separator (8). However, the helicoidal separator (8) makes it possible to increase separation efficiency in small-diameter wells, the increase in the diameter of the separator being replaced by the increase in its length. The greater the length, the greater will be the separation efficiency, since the gas bubbles will have longer to reach the surface of the free surface channel formed on the helicoidal surfaces.

The area of the annulus between the perforated tube (21) and the production tubing (22) must be as large as possible in order to prevent flooding by liquid and to reduce the thickness and speed of the cascade. The diameter of the perforated tube (21) should be less than or equal to the passage diameter (drift) of the casing (9). The perforated tube (21) should preferably be "fishable".

Use is made of a suction tube (6) at the inlet of the pump (12) so that a significant coalescence of bubbles occurs at the change in section located at the upper end thereof. Thus, small bubbles which are entrained downwards, in the annular space between the sedimentation vessel (3) and the pump (12), but which are not entrained in the annular space between the sedimentation vessel (3) and the suction tube (6), stop in the region where the change in section occurs and coalesce to form large bubbles capable of ascending via the annular space between the sedimentation vessel (3) and the pump (12).

In order not to give rise to an excessive pressure loss and, consequently, so as not to cause undesirable expansion of the gases at the pump (12) inlet, the suction tube (6) should not have a very small diameter.

Coalescence of bubbles is minimal along the stabilized descending vertical flow with constant section. Thus, the suction tube (6) should have the shortest length possible in order not to give rise to an excessive loss of pressure and so that the separator (8) is not unnecessarily long. Its length should be sufficient only to stabilize the flow, after the change in section of the annular space, when passing from the pump (12) to the suction tube (6).

It is recommended that the pressure loss in the suction tube (6) be, as a maximum, of the order of one metre column of water, since the gas at atmospheric pressure expands by only ten per cent. It is further recommended that the length of the suction tube (6) be from five to ten times (estimated value) as great as the thickness of the annular space between the suction tube (6) and the sedimentation vessel (3).

Construction of Prototypes

Separator prototypes were constructed, according to this invention, for tests in petroleum wells. These were:

- a full helicoidal separator having modular components to allow testing of the separator in a variety of arrangements;
- a compact helicoidal separator, which is an initial design for reducing manufacturing costs and the costs of operating a rig;
- a cascade separator, which is the simplest and most inexpensive of all and will make it possible quantitatively to assess the significance of the helicoidal surfaces.

Amongst various other results, during the basic prototype project the following was observed:

- generally speaking, all the components should be of minimum thickness in order to maximize the internal volume of the separator;
- the greater the length of the separator, the more efficient separation will be;
- separation quality increases and capacity decreases when the angle or pitch of the helicoidal surface is reduced;
- separators with helicoidal surfaces of 5° and 10° of inclination have a lower separation capacity than the conventional (or poor boy) separator, although separation quality is substantially superior;
- in the case of low-viscosity wells, with 5½ inch casing, the maximum separation capacity is of the order of 340 $m^3$ of liquid per day, using a helicoidal surface with 45° of inclination, 35 per cent of the cross section of the helicoidal channel being occupied by liquid;
- in the case of low-viscosity wells, with 7 inch casing, the maximum separation capacity is of the order of 1300 $m^3$ of liquid per day, using a helicoidal surface with 45° of inclination, 35 per cent of the cross section of the helicoidal channel being occupied by liquid;
- in the case of high-viscosity wells, the separation capacity drops;
- for each operating condition, there is a pitch and a number of helicoidal surfaces which provide maximum separation efficiency;
- the best separation efficiency result for a well with 5% inch casing, low viscosity and low flow rate is obtained with 6 helicoidal surfaces with 100 of inclination;
- the best separation efficiency result for a well with 7 inch casing, low viscosity and low volume is obtained with 8 helicoidal surfaces with 5° of inclination;
- in the case of the prototypes, a single helicoidal surface with 18° of inclination was adopted, because a greater inclination should prevent the accumulation of sand and of organic and inorganic detritus on the helicoidal surfaces and because a separator with only one helicoidal surface is easier to manufacture.

What is claimed is:

1. A gas separator for separating out the gaseous phase from a two-phase, liquid/gas mixture, comprising:

- a sedimentation vessel having an upper part through which a production tubing extends into an interior of the sedimentation vessel, having an outlet in said upper part for the exit of gas that has been separated out, and having a lateral surface with an upper portion having through-holes therein so as to define a perforated tube; wherein in use said sedimentation vessel contains liquid in a lower part thereof up to a level varying within a selected band below the holes in said perforated tube, and contains predominantly gas in said upper portion, above the level of the liquid;
- a discharge pump operatively coupled to the production tubing; and level control means for keeping the level of the liquid inside the sedimentation vessel within said selected band.

2. A separator according to claim 1, wherein said discharge pump includes a suction pipe.

3. A separator according to claim 1, wherein said level control means comprises a control valve in the gas line.

4. A gas separator according to claim 1, installed at a bottom of a well equipped with means for lifting the liquid by pumping and wherein the sedimentation vessel has on the inside a helicoidal surface extending over the length of a height thereof, predominantly below said perforated tube, resting on the outer surfaces of the production tubing and pump and on the inner lateral surface of the sedimentation vessel, thereby defining a helicoidal channel.

5. A separator according to claim 4 wherein said helicoidal surface has a variable pitch.

6. A separator according to claim 4, wherein the sedimentation vessel has, on the inside, at least two helicoidal surfaces which are, equally offset along the circumference of the sedimentation vessel.

7. A separator according to claim 4, further comprising a discharge tube extending over the upper portion of the helicoidal channel, said discharge tube extending from the lower portion of the helicoidal surface to the annulus of the well, above the dynamic level of the well.

8. A separator according to claim 7, wherein said discharge tube is next to the production tubing.

9. Method of using a separator for separating out the gaseous phase from a two-phase, liquid/gas mixture, the separator comprising: a sedimentation vessel having an upper part through which a production tubing extends into an interior of the sedimentation vessel, having an outlet in said upper part for the exit of gas that has been separated out into a gas line, and having a lateral surface with an upper portion having through-holes therein so as to define a perforated tube; wherein in use said sedimentation vessel contains liquid in a lower part thereof and contains predominantly gas in said upper portion, above the level of the liquid; and a discharge pump operatively coupled to the production tubing, said method, comprising the steps of:

(a) fitting the separator in a well bottom;

(b) installing a regulating valve in the gas line;

(c) determining the dynamic level of the well;

(d) moving the dynamic level inside the separator, below the region of the holes in the perforated tube, by operating the regulating valve; and (e) keeping the liquid level in the separator within a specified variation band.

10. A method according to claim 9, wherein the step of keeping the liquid level in the separator within a specified variation band is carried out automatically using at least one sensor and said valve.

* * * * *